US006213962B1

(12) United States Patent
Shimizu

(10) Patent No.: US 6,213,962 B1
(45) Date of Patent: Apr. 10, 2001

(54) ROLLER MASSAGING MECHANISM AND MASSAGING APPARATUS INCORPORATING THE SAME

(75) Inventor: Nobuzo Shimizu, Higashi-Osaka (JP)

(73) Assignee: Daito Electric Machine Industry Company Limited, Osaka (JP)

( * ) Notice: Subject to any disclaimer, the term of this patent is extended or adjusted under 35 U.S.C. 154(b) by 0 days.

(21) Appl. No.: 09/341,634

(22) PCT Filed: Mar. 17, 1999

(86) PCT No.: PCT/JP99/01340

§ 371 Date: Jul. 15, 1999

§ 102(e) Date: Jul. 15, 1999

(30) Foreign Application Priority Data

May 7, 1998 (JP) ..... 10-124893

(51) Int. Cl.[7] ..... A61H 7/00
(52) U.S. Cl. ..... 601/90; 601/93; 601/94
(58) Field of Search ..... 601/22, 27, 28, 601/61, 63, 86, 87, 90–91, 93–95, 97–101, 104, 106, 80

(56) References Cited

U.S. PATENT DOCUMENTS

| | | | | |
|---|---|---|---|---|
| 3,633,571 | * | 1/1972 | Shinagawa | 601/118 |
| 4,422,448 | * | 12/1983 | Sugai et al. | 601/102 X |
| 4,718,408 | * | 1/1988 | Barreiro | 601/99 |
| 5,179,940 | * | 1/1993 | Barreiro | 601/126 X |
| 5,445,595 | * | 8/1995 | Chou | 601/116 X |
| 5,460,598 | * | 10/1995 | Yamasaki et al. | 601/115 X |
| 5,643,181 | * | 7/1997 | Lin | 601/115 X |
| 5,741,218 | * | 4/1998 | Fujii | 601/90 |
| 6,083,181 | * | 7/2000 | Marcantoni | 601/90 X |

FOREIGN PATENT DOCUMENTS

| | | |
|---|---|---|
| 56-119251 | 9/1981 | (JP) . |
| 59-28963 | 2/1984 | (JP) . |
| 60-135122 | 9/1985 | (JP) . |
| 2109628 | 9/1990 | (JP) . |
| 478307 | 12/1992 | (JP) . |

* cited by examiner

*Primary Examiner*—Danton D. DeMille
*Assistant Examiner*—Denise Pothier
(74) *Attorney, Agent, or Firm*—Birch, Stewart, Kolasch & Birch, LLP

(57) ABSTRACT

A roller massaging mechanism of a type having a pair of right and left massaging rollers mounted on an intermediate portion of a rotary shaft in a slanted fashion relative to an axis of the rotary shaft, and includes a switching member for selectively switching the position of the pair of right and left massaging rollers into one of a kneading position where the pair of massaging rollers are slanted opposite to each other and a non-kneading position where the massaging rollers are slanted parallel with each other. When the massaging rollers are caused to assume the kneading position by the switching member, a kneading massage operation is performed, while when the massaging rollers are caused to assume the non-kneading position, a massage operation other than the kneading massage operation such as a finger pressure-like massage or a tapping massage is performed

14 Claims, 15 Drawing Sheets

ROLLER MASSAGING MECHANISM AND MASSAGING APPARATUS INCORPORATING THE SAME

This application is the national phase under 35 U.S.C. §371 of PCT International Application No. PCT/JP99/01340 which has an International filing date of Mar. 17, 1999 which designated the United States of America.

TECHNICAL FIELD

The present invention relates to a roller massaging mechanism capable of performing a variety of massaging operations for a human and massaging apparatus incorporating such mechanism.

BACKGROUND ART

Conventional massaging apparatus incorporating a roller massaging mechanism include a bed-type one as described, for example, in Japanese Unexamined Patent Publication No. SHO 59-28963 and a relatively compact stationary-type one as described, for example, in Japanese Examined Patent Publication HEI No. 4-78307 or Japanese Unexamined Utility Model Publication No. HEI 2-109628.

The bed-type massaging apparatus includes a roller massaging mechanism which is shiftable in the longitudinal direction of the bed. The massaging mechanism comprises a transversely extending rotary shaft capable of moving longitudinally of the bed, and a pair of right and left massaging rollers mounted on the rotary shaft as slanted relative to the axis of the rotary shaft, the rollers being slanted opposite to each other.

The aforementioned stationary-type massaging apparatus comprises a compact stationary-type casing having an opening oriented upward and a roller massaging mechanism disposed in the casing. In this arrangement, the roller massaging mechanism comprises a rotary shaft rotatably supported by the casing, and a pair of right and left disc-shaped massaging rollers mounted on the rotary shaft at an intermediate location corresponding to the opening, the pair of right and left massaging rollers being mounted as slanted relative to the axis of the rotary shaft in opposite directions.

Since the pair of right and left massaging rollers are slanted opposite to each other in the roller massaging mechanism, the distance between the peripheries of the massaging rollers is widened and narrowed as the rotary shaft rotates, whereby when the massaging rollers are pressed against an affected part of a user, they perform a kneading massage.

In the conventional roller massaging mechanism, however, the pair of right and left massaging rollers are fixed on the rotary shaft as slanted opposite to each other and, hence, the slanting direction of each roller relative to the rotary shaft cannot be varied, thus providing the kneading massage only.

Accordingly, the conventional massaging mechanism capable of performing only the kneading massage with the pair of right and left slanted massaging rollers cannot meet users' diversified needs and tends to let users lose their interest easily.

Although a variety of massaging apparatus performing various massaging operations as well as the kneading massage have been suggested, such massaging apparatus generally have a complicated structure in the drive system of massaging members or in the control program for performing various massaging operations and, hence, are large in size and expensive.

The present invention has been accomplished in view of the above circumstances, and it is an object of the present invention to provide a roller massaging mechanism which can perform, as well as the kneading massage, other massaging operations with a less complicated structure, and massaging apparatus incorporating such mechanism.

DISCLOSURE OF INVENTION

The present invention provides the following technical means to attain the above objects.

A roller massaging mechanism according to the present invention is of a type having a pair of right and left massaging rollers mounted on an intermediate portion of a rotary shaft in a slanted fashion relative to an axis of the rotary shaft, and includes switching means for selectively switching the position of the pair of right and left massaging rollers into one of a kneading position where the pair of massaging rollers are slanted opposite to each other and a non-kneading position where they are slanted parallel with each other.

The switching means may be, for example, a mechanical structure in which the position of the massaging rollers is changed by switching the rotational direction of the rotary shaft (for example, a half-turn clutch as described later), but is not limited to this structure.

With this arrangement, when the massaging rollers are slanted in the same direction to assume the non-kneading position, the outer peripheries of the massaging rollers move their points of contact with an affected part to the right and left while maintaining a predetermined spacing therebetween, resulting in a massaging operation other than the kneading massage.

On the other hand, when the rotary shaft is rotated with the massaging rollers assuming the kneading position, the outer peripheries of the massaging rollers move their points of contact with the affected part toward and away from each other, thereby performing the kneading massage relative to the affected part.

The present invention recommends that the pair of right and left massaging rollers be mounted eccentrically relative to the rotary shaft such that a portion of one massaging roller which is closer to a corresponding portion of the other massaging roller becomes more distant from the rotary shaft than a portion of said one massaging roller which is more distant from a corresponding portion of said other massaging roller.

With this eccentric arrangement, rotation of the rotary shaft with the massaging rollers in the non-kneading position causes the massaging rollers to perform a massaging operation such that the respective outer peripheries of the massaging rollers repeatedly reciprocate against an affected part alternately with each other. When the rotary shaft rotates at a relatively low speed, such alternating reciprocation of the outer peripheries of the massaging rollers is equivalent to pressing the affected part slowly (finger pressure-like massage) while when the rotary shaft rotates at a relatively high speed, it is equivalent to tapping the affected part (tapping massage).

Accordingly, the present invention provides not only the kneading massage but also the finger pressure-like massage or the tapping massage by the use of the massaging rollers only, thereby realizing the roller massaging mechanism capable of performing the kneading massage and other massaging operations with a less complicated structure and lower cost.

The change of the rotational speed of the rotary shaft can be achieved by imparting the drive means with a function of varying the rotational speed of the rotary shaft to at least two levels when the pair of right and left massaging rollers are in the non-kneading position.

More specific modes of the roller massaging mechanism according to the present invention are as follows.

The rotary shaft according to the present invention may be divided into a first shaft portion supporting one massaging roller and a second shaft portion supporting the other massaging roller and disposed coaxially with the first shaft portion. In this case, the switching means may comprise a half-turn clutch which restricts relative rotation between the first shaft portion and the second shaft portion to about a half turn.

In this arrangement, when the direction of the rotation of, for example, the first shaft portion is switched by the drive means, the position of the second shaft portion relative to the first shaft portion for rotation is changed by a half turn. Thus, the position of the massaging rollers can be switched to one of the kneading position and the non-kneading position selectively by simply rotating the rotary shaft forwardly or backwardly by means of the drive means, thereby extremely facilitating the switching and controlling of the position of the massaging rollers.

More specifically, the half-turn clutch may include a tubular member unrotatably and coaxially secured to an end portion of the second shaft portion and defining in an outer periphery thereof a transverse slot having a length circumferentially of the tubular member which corresponds to the half turn; and a stopper pin projecting radially outwardly of an end portion of the first shaft portion rotatably and coaxially inserted into the tubular member and having a tip portion staying within the transverse slot.

Where the rotary shaft is divided into the first shaft portion and the second shaft portion, which are then interconnected through the half-turn clutch as described above, too easy of a relative rotation between the first and second shaft portions would cause the driven shaft portion to rotate relative to the driving shaft portion undesirably due to the pressure imposed on the massaging rollers from an affected part of the user, thereby rotating the massaging rollers with their kneading or non-kneading position instantaneously collapsed, which may result in a case where a proper massaging operation becomes impossible.

Therefore, it is recommended that brake means be provided for applying a frictional resistance against rotation of one of the first and second shaft portions which is situated on a driven side that is not directly rotary-driven by the drive means.

In this case, though the massaging roller supported by the driven shaft portion receives pressure from the affected part, a braking member restrains the second shaft portion from rotating relative to the first shaft portion thereby preventing the collapse of the kneading or non-kneading position of the massaging rollers, hence allowing for a proper massage operation with the massaging rollers maintained in the kneading or non-kneading position properly.

Further, though it is preferred that the pair of right and left massaging rollers are coupled to the rotary shaft so as to be rotatable relative to the rotary shaft for preventing unnecessary friction against the affected part and the cover member, too easy of a rotation of the massaging rollers relative to the rotate shaft would cause the massaging rollers to change their slanted direction(s) instantaneously due to the pressure received from the affected part, which may also result in an improper massage operation.

Therefore, it is recommended that second brake means be provided for applying a frictional resistance against the rotation of the pair of right and left massaging rollers relative to the rotary shaft.

The roller massaging mechanism of the present invention does not exclude any additional massaging member other than the pair of right and left massaging rollers.

For example, it is possible to provide a multiplicity of mini-rollers around a portion of the rotary shaft situated closer to each end of the rotary shaft than a portion of the rotary shaft on which the pair of right and left massaging rollers are mounted, for performing a rolling massage relative to an affected part. With this arrangement the user can enjoy, in addition to the kneading massage and finger pressure-like massage by the pair of right and left massaging rollers, the rolling massage by the multiplicity of mini-rollers if the affected part is moved closer to each end of the rotary shaft.

The roller massaging mechanism according to the present invention may be incorporated in various types of massaging apparatus such as relatively small massaging apparatus of stationary type or hand-carriable type, and relatively large massaging apparatus of leaner type or chair type.

Where the roller massaging mechanism is incorporated in massaging apparatus of the leaner type or chair type, it is preferred that shift means be provided for shifting the roller massaging mechanism upwardly and downwardly so as to massage a larger longitudinal extent of the back of a human.

BEST MODE FOR CARRYING OUT INVENTION

The present invention will now be described with reference to the drawings.

FIGS. 1 to 8 show a first embodiment of the present invention.

Figure 3:
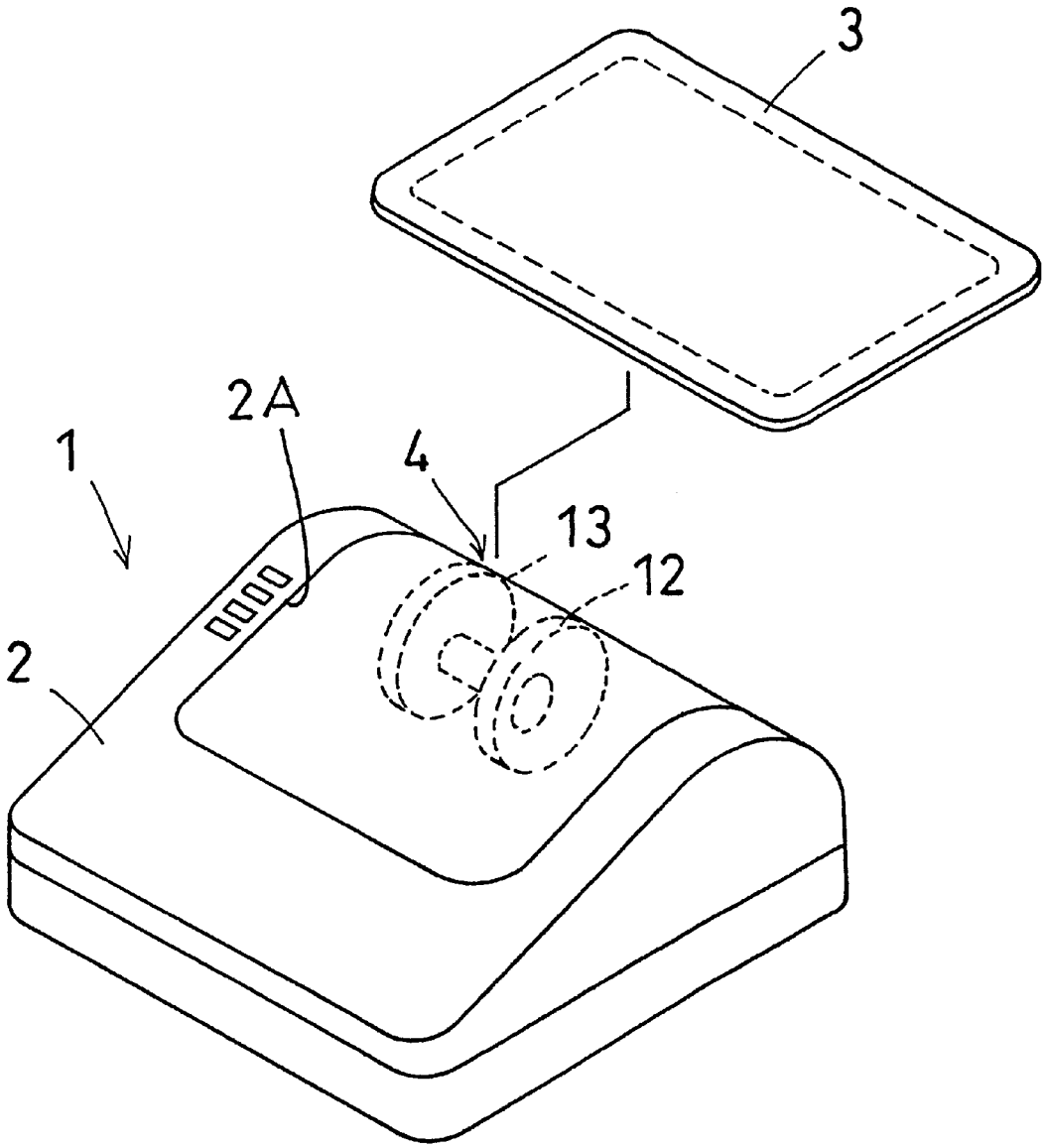
FIG. 3 is a perspective view of the massaging apparatus of stationary type.

FIG. 3 illustrates an example of massaging apparatus 1 incorporating therein roller massaging mechanism 4 according to the present invention. The massaging apparatus 1 shown is of a stationary type which is relatively compact and flat.

This stationary-type massaging apparatus 1 includes a stationary-type casing 2 defining an opening 2A oriented upwardly, and the roller massaging mechanism 4 housed in the casing 2, the opening 2A being closed with a flexible cover member 3 formed of a stretch fabric or the like. The massaging apparatus 1 can be used by, for example, being placed under the back, waist, thighs or calves of a human lying on his or her back, or under the feet of a human sitting on a chair.

Figure 1:
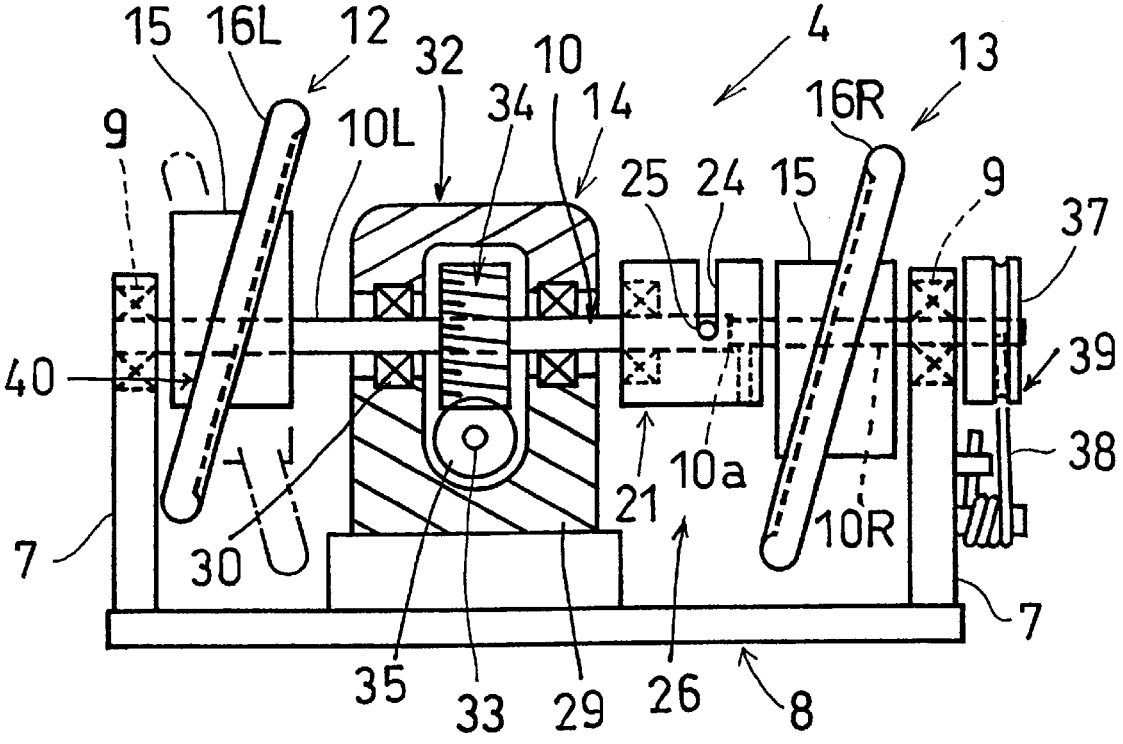
FIG. 1 is a front view of a roller massaging mechanism as viewed from line A—A in FIG. 2.
Figure 2:
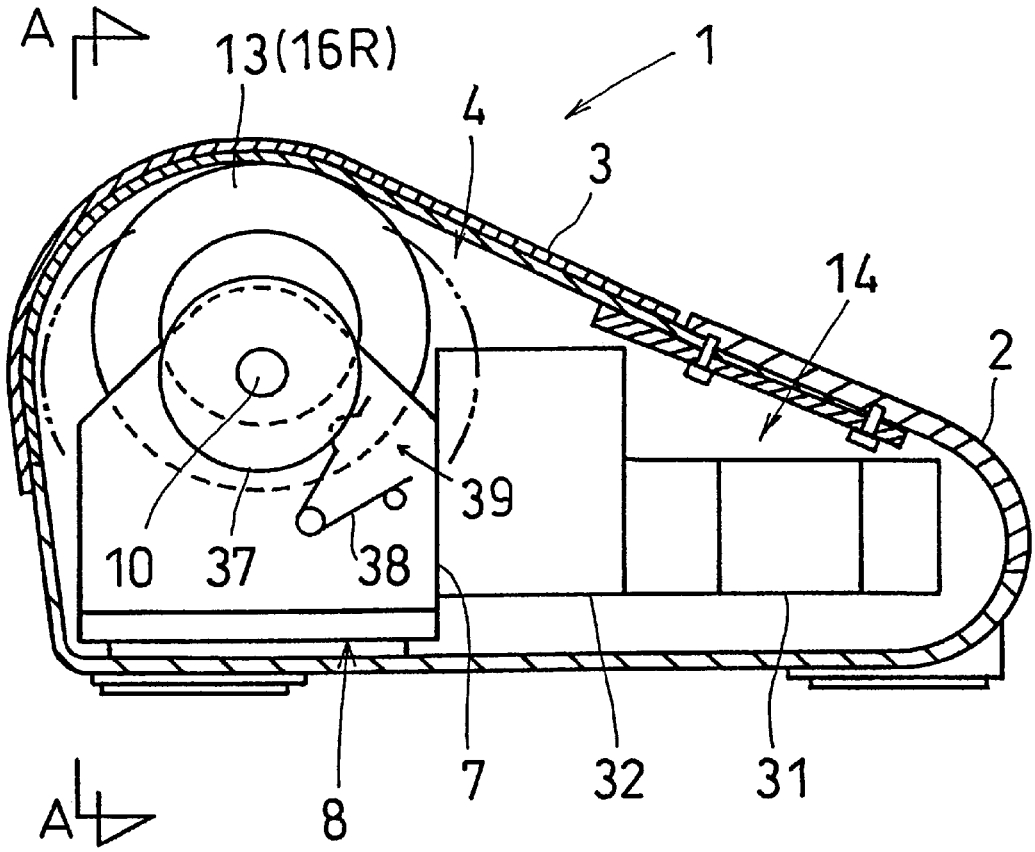
FIG. 2 is a side sectional view of a massaging apparatus as viewed from the left-hand side in FIG. 3.

As shown in FIGS. 1 and 2, the roller massaging mechanism 4 includes a support frame 8 having at right and left ends thereof right and left support brackets 7,7 with a predetermined spacing therebetween, a rotary shaft 10 extending between and rotatably supported by the brackets 7,7 of the support frame 8 through bearings 9, a pair of right and left rotors 13 and 12 mounted on the rotary shaft 10 in a slanted fashion relative to the axis of the rotary shaft 10, and drive means 14 for rotary-driving the rotary shaft 10.

The right and left rotors 13,12 are arranged in the casing 2 at a location corresponding to the opening 2A and include respective boss portions 15 fitted around the rotary shaft 10 eccentrically therewith, and respective massaging rollers 16R,16L which are each in a substantially discoid configuration and held by the corresponding boss portions 15 as slanted relative to the axis of the rotary shaft 10.

Figure 4:
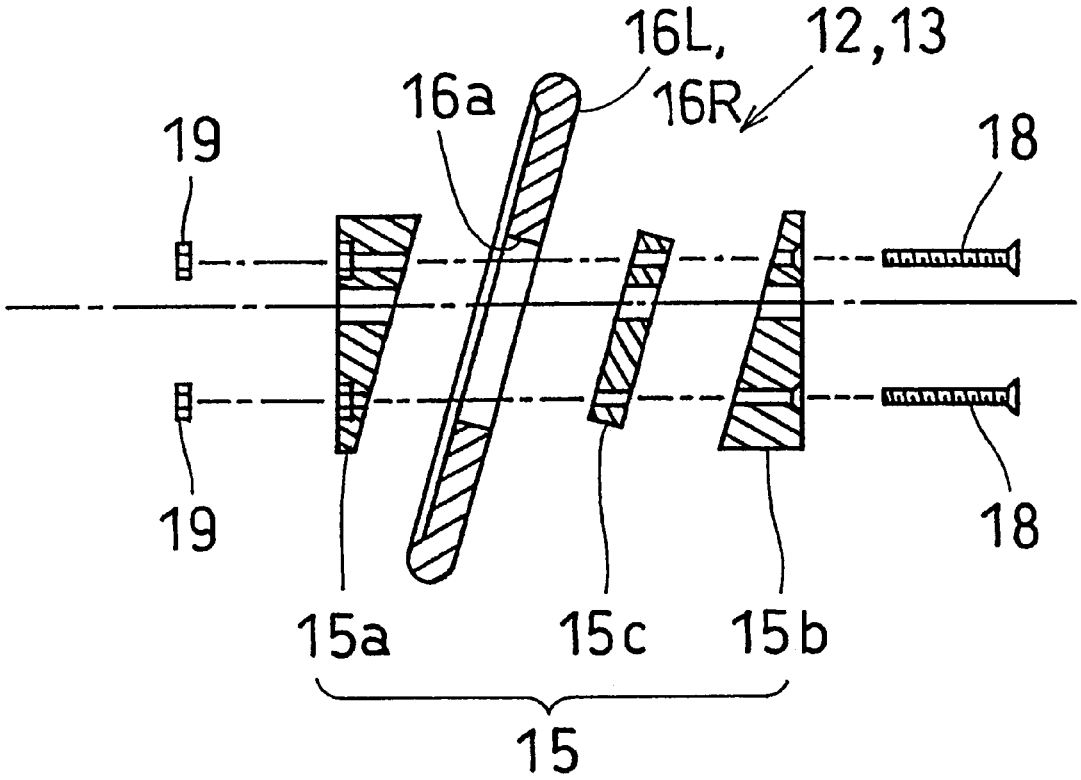
FIG. 4 is an exploded sectional view of a rotor.

As shown in FIG. 4, each of the boss portions 15 includes a pair of sandwiching plates 15*a* and 15*b* each in the form of a section of a cylinder sectioned askew relative to the axis of the cylinder, and a central plate 15*c* held as sandwiched by these sandwiching plates 15*a* and 15*c*.

These plates 15*a*, 15*b* and 15*c* are integrated together into each boss portion 15 by placing the sandwiching plates 15*a* and 15*b* on opposite sides of each massaging roller 16R,16L centrally receiving the central plate 15*c* and then fastening the plates 15*a*, 15*b* and 15*c* with use of a bolt extending through these three plates and a nut.

The boss portions 15 are each prevented from rotating relative to the rotary shaft 10 by a relative rotation preventive structure not shown and hence are adapted to rotate together with the rotary shaft 10.

The central plate 15*c* is shaped discoid with its opposite sides respectively abutting the slanted end faces of the sandwiching plates 15*a* and 15*b*. Thus, the central plate 15*c* is slanted relative to the axis of the rotary shaft 10. It should be noted that the central plate 15*c* may be formed integrally with one of the sandwiching plates 15*a* and 15*b*, or alternatively the central plate 15*c* may be composed of mating halves cut at the center of the thickness of the plate 15*c* which are formed integrally with the sandwiching plates 15*a* and 15*b*, respectively.

The massaging rollers 16R, 16L are each shaped discoid defining a central hole 16*a* in a central portion thereof for slidably receiving the central plate 15*c* for rotation relative to the central plate 15*c*. Thus, the massaging rollers 16R, 16L are rotatably coupled to the rotary shaft 10 as slanted relative to the axis of the rotary shaft 10.

As shown in FIG. 1, the rotary shaft 10 includes a first shaft portion 10L supporting the-left massaging roller 16L, and a second shaft portion 10R supporting the right massaging roller 16R, the second shaft portion 10R being coaxially aligned with the first shaft portion 10L. The first shaft portion 10L has a portion for mounting the left rotor 12 and a portion extending through the drive means 14 in this order from the left, while the second shaft portion 10R has a portion for mounting the right rotor 13.

The rotary shaft 10 is divided into the first and second shaft portions 10L and 10R at a dividing end 10*a* located between the drive means 14 and the right rotor 13. Dividing end portions 10*b* and 10*c* of the first and second shaft portions 10L and 10R are interconnected through a half-turn clutch 21.

Figure 5:
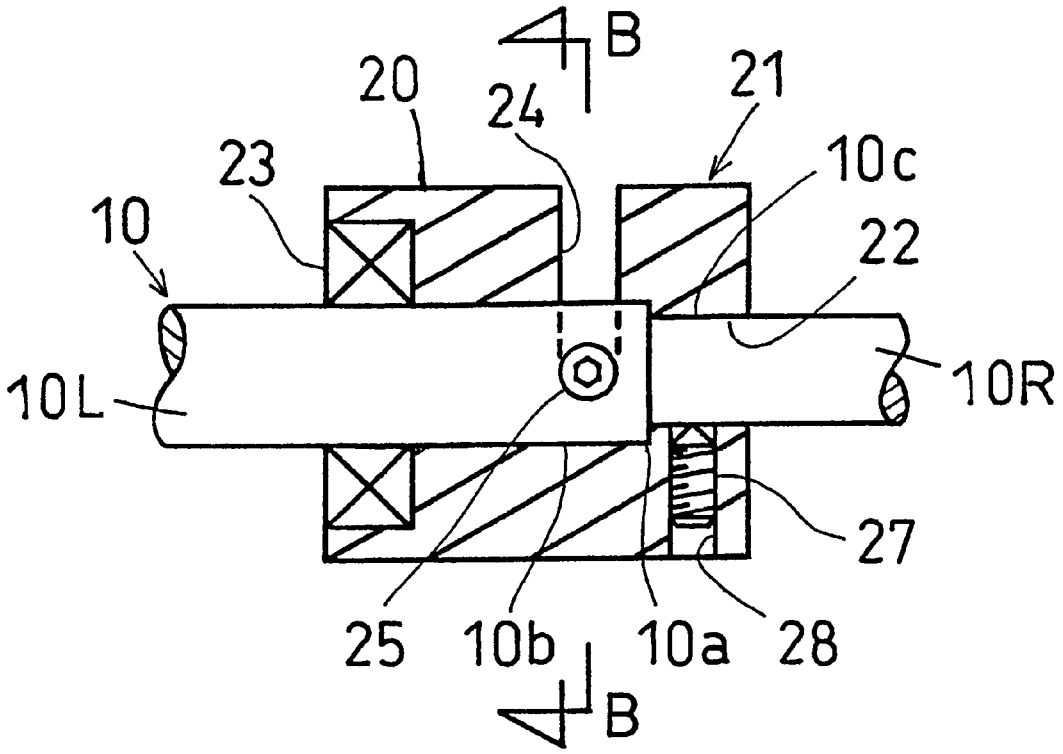
FIG. 5 is an enlarged sectional view showing a half-turn clutch.
Figure 6:
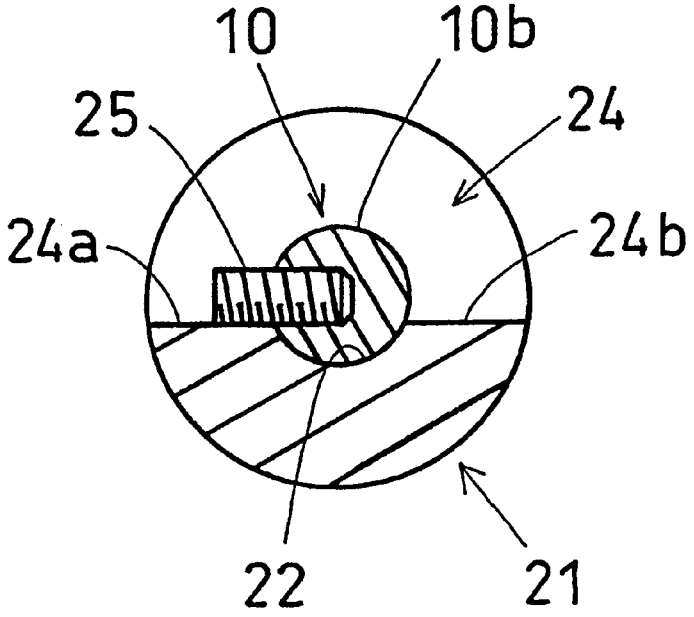
FIG. 6 is a sectional view taken along line B—B in FIG. 5.

As shown in FIGS. 5 and 6, the half-turn clutch 21 includes a tubular member 20 unrotatably and coaxially secured to the dividing end portion 10*c* of the second shaft portion 10R, and a stopper pin 25 projecting radially outwardly of the dividing portion 10*b* of the first shaft portion 10L coaxially and rotatably inserted into the tubular member 20.

The tubular member 20 is shaped cylindrical having a bore 22 axially extending through a central portion thereof, and a bearing 23 located on a peripheral edge portion of the opening adjacent the drive means 14 (on the left-hand side in FIG. 5) for receiving the dividing end portion 10*b* of the first shaft portion 10L for rotation. Further, the tubular member 20 is formed in an axially intermediate portion thereof with a semicircular transverse slot 24 which has a length circumferentially of the tubular member 20 corresponding to a half turn and which has a depth from the outer peripheral surface of the tubular member 20 to the bore 22.

The stopper pin 25 is secured to the dividing end portion 10*b* of the first shaft portion 10L by, for example, thread engagement of a setscrew so as to project radially outwardly, and the tip portion of the pin 25 movably stays within the transverse slot 24.

The tubular member 20 defines in a right-hand side end portion thereof a tapped hole 28 for thread engagement with a setscrew 27 preventing the dividing end portion 10*c* of the second shaft portion 10R from rotating relative to the tubular member 20.

As is apparent from the above, the first shaft portion 10L of the rotary shaft 10 supporting the left rotor 12 is turnable relative to the tubular member 20 forming the half-turn clutch 21 within a range of a half turn, while the second shaft portion 10R of the rotary shaft 10 supporting the right rotor 13 is secured to the tubular member 20 unrotatably relative thereto.

Accordingly, when the first shaft portion 10L of the rotary shaft 10 is rotated counterclockwise in FIGS. 2 and 6 by the drive means 14, the stopper pin 25 comes to abut one radial end face 24*a* of the semicircular transverse slot 24 thereby causing the second shaft portion 10R to rotate counterclockwise together with the first shaft portion 10L.

On the other hand, when the first shaft portion 10L is rotated clockwise from the condition where the stopper pin 25 abuts the radial end face 24*a*, the stopper pin 25 moves within the transverse slot 24 to abut the other radial end face 24*b* of the slot 24 thereby causing the second shaft portion 10R to rotate clockwise together with the first shaft portion 10L.

As the stopper pin 25 moves from the radial end face 24*a* to the opposite radial end face 24*b*, the right rotor 13 mounted on the second shaft portion 10R on the driven side makes a half turn relative to the left rotor 12.

As a result, the respective massaging rollers 16R, 16L of the right and left rotors 13 and 12 can assume a non-kneading position where the two massaging rollers 16L and 16R are slanted in the same direction parallel with each other as indicated in solid line or alternatively a kneading position where the two massaging rollers 16L and 16R are slanted in opposite directions as indicated in phantom line of FIG 1.

In this way the half-turn clutch 21 forms switching means 26 for selectively switching the position of the massaging rollers 16R, 16L into one of the kneading position where the pair of opposite massaging rollers 16L and 16R are slanted opposite to each other and the non-kneading position where they are slanted in the same direction.

Figure 7:
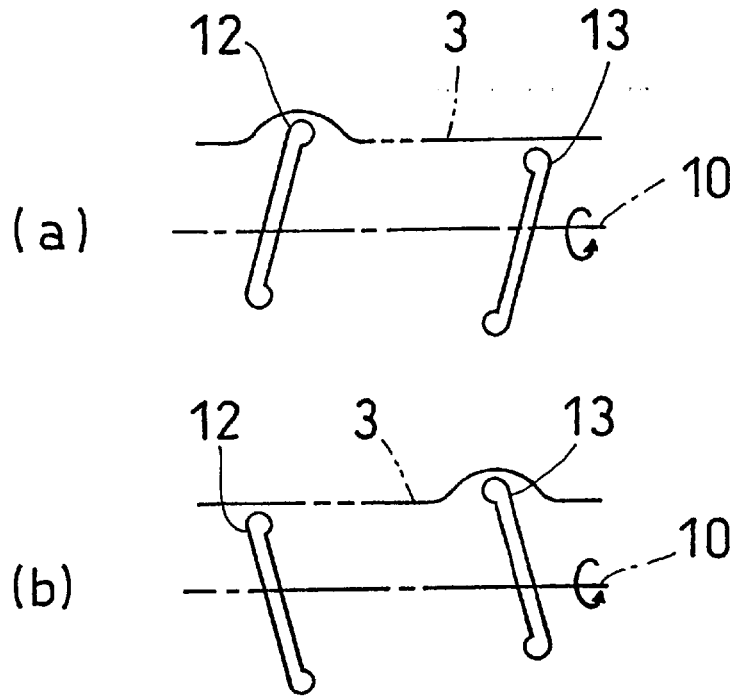
FIG. 7 is a schematic view illustrating the massaging operation of massaging rollers in a non-kneading position.

In the non-kneading embodiment the massaging rollers 16R,16L are mounted eccentrically relative to the rotary shaft 10 such that, as illustrated in FIG. 7(*a*), a lower portion of lower the right rotar 13 selectively becomes more distant from the rotary shaft 10 than a lower portion of lower the left rotar 12 by making the boss portion 15 of each rotor 12,13 eccentric relative to the rotary shaft 10. As illustrated in FIG. 7(*b*), by rotating the rotary shaft 10 counterclockwise, the lower end of the left rotor 12 selectively becomes more distant from the rotary shaft 10 than a lower portion of the right rotor 13.

For this reason, when the rotary shaft is rotated with the massaging rollers 16R,16L in the non-kneading position, they perform a massage operation such that the respective outer peripheries of the rollers 16R, 16L reciprocate against an affected part of the user's body alternately with each other, as shown in FIGS. 7(*a*) and 7(*b*). In this case it is preferred that the stroke between the outer periphery of each roller 16R,16L be set to about 15 mm.

As shown in FIG. 2, the drive means 14 includes a motor 31, and a reduction gear device 32 for transmitting the driving power of the motor 31 to the rotary shaft 10 (first shaft portion 10L) at a reduced speed, the reduction gear device 32 being either integral with or separate from the motor 31.

As shown in FIG. 1, the reduction gear device 32 includes a gear case 29 receiving therethrough the rotary shaft 10 via bearings 30 for rotation, a worm wheel 34 secured to a portion of the rotary shaft 10 situated within the gear case 29, and a worm 35 secured to output shaft 33 of the motor 31 so as to mesh with the worm wheel 34.

In this embodiment the motor 31 can revolve forwardly and backwardly by way of an electric control circuit not shown and, hence, the forward rotation of the rotary shaft 10 can be switched to the backward rotation, and vice versa.

The electric control circuit of the drive means 14 is capable of varying the rotary speed of the rotary shaft 10 to at least two levels when the massaging rollers 16R,16L are in the non-kneading position. This speed varying operation may be effected stepwise or steplesswise. Further, the speed varying function may be controlled mechanically (including change of gear combination) instead of the electric control using the control circuit.

Where the massaging rollers 16R,16L are in the non-kneading position (in the case of FIG. 7), rotating the rotary shaft 10 at a relatively low speed causes the respective outer peripheries of the rollers 16R,16L to reciprocate relatively slowly in an alternate fashion thereby providing a finger pressure-like massage such as to press an affected part heavily from the right and left.

To achieve such a finger pressure-like massage, the rotary speed of the rotary shaft 10 is set to about 50 rpm.

On the other hand, rotating the rotary shaft 10 at a relatively high speed with the massaging rollers 16R,16L in the non-kneading position (in the case of FIG. 7) causes the respective outer peripheries of the rollers 16L,16R to reciprocate alternately at a higher speed thereby giving impacts to the affected part, thus resulting in a tapping massage.

To achieve such a tapping massage, the rotary speed of the rotary shaft 10 is set to 150 rpm or higher, and the rotary speed of 200 rpm provides the user with a particularly advantageous tapping massage.

When the rotary shaft 10 is rotated with the outer peripheries of the massaging rollers 16R,16L abutting an affected part of the user, there is the possibility that the massaging roller 16R supported on the second shaft portion 10R situated on the driven side changes its slanted direction instantaneously due to the pressure from the affected part, resulting in an improper massage.

More specifically, since the first and second shaft portions 10L and 10R into which the rotary shaft 10 is divided are interconnected through the half-turn clutch 21, too easy of a relative rotation between these shaft portions 10L and 10R would cause the second shaft portion 10R to rotate relative to the first shaft portion 10L undesirably due to the pressure imposed on the right massaging roller 16R from the affected part thereby rotating the massaging rollers 16R,16L with their kneading or non-kneading position instantaneously collapsed, thus resulting in a case where a proper massage becomes impossible.

Although the pair of massaging rollers 16R,16L are preferably mounted for rotation relative to the rotary shaft 10 to prevent unnecessary friction between these rollers and an affected part of the user and between these rollers and the cover member 3, too easy rotation of the massaging rollers 16R,16L relative to the rotary shaft 10 would cause the massaging rollers 16R,16L to change their slanted direction (s) instantaneously, which also results in an improper massage.

To prevent such inconveniences this embodiment is provided with first brake means 39 for providing a frictional resistance against rotation of the second shaft portion 10R on the driven side which is not driven by the drive means 14, and second brake means 40 for providing frictional resistance against rotation of the pair of massaging rollers 16R,16L relative to the rotary shaft 10.

The first brake means 39 comprises a friction wheel 37 attached to the projecting end of the second shaft portion 10R, and a pressing spring 38 secured to the support bracket 7 so that an end portion thereof presses upon the outer periphery of the friction wheel 37.

The second brake means 40 comprises pressing the respective slanted faces of the sandwiching plates 15*a* and 15*b* upon each massaging roller 16R,16L with an appropriate pressure.

When the rotary shaft 10 of the massaging apparatus 1 of the above construction is rotated counterclockwise in FIGS. 2 and 6, the massaging rollers 16R,16L of the rotors 13 and 12 rotate in the non-kneading position where the massaging rollers 16R,16L are parallel with each other, with the result that the respective outer peripheries of the massaging rollers 16R,16L alternately reciprocate against an affected part of the user.

In this case, adjusting the rotary speed of the rotary shaft 10 to a relatively low speed (about 50 rpm) realizes the finger pressure-like massage in which the massaging rollers 16R,16L alternately and slowly press the affected part. Alternatively, adjusting the rotary speed of the rotary shaft 10 to a relatively high speed (150 rpm or higher, advantageously about 200 rpm) realizes the tapping massage where the massaging rollers 16R, 16L alternately give impacts to the affected part.

Figure 8:
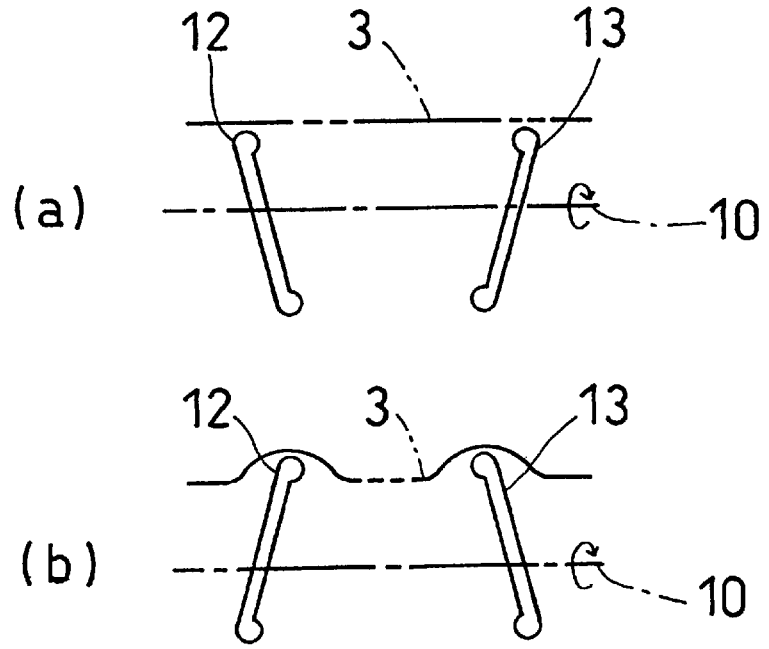
FIG. 8 is a schematic view illustrating the massaging operation of massaging rollers in a kneading position.

On the other hand, when the rotary shaft 10 is rotated clockwise in FIGS. 2 and 6, the massaging rollers 16R,16L of the rotors 13 and 12 rotate in the kneading position, with the result that the respective outer peripheries of the massaging rollers 16R,16L expand while gradually coming closer to each other and subsequently retract while going away from each other as shown in FIG. 8, thereby providing the kneading massage.

It should be noted that the rotary speed of the rotary shaft 10 is preferably set within a range from about 50 to about 60 rpm in the kneading massage.

The massaging apparatus 1 according to this embodiment is capable of selectively performing the kneading massage and other massaging operations by simply switching the rotational direction of the rotary shaft 10. Further, by simply varying the rotary speed of the rotary shaft 10 when the massaging rollers 16R,16L are in the non-kneading position, the massage apparatus 1 can selectively perform the finger pressure-like massage and the tapping massage. Thus, the massaging rollers 16 of a single kind allow for three different kinds of massaging operations.

Figure 9:
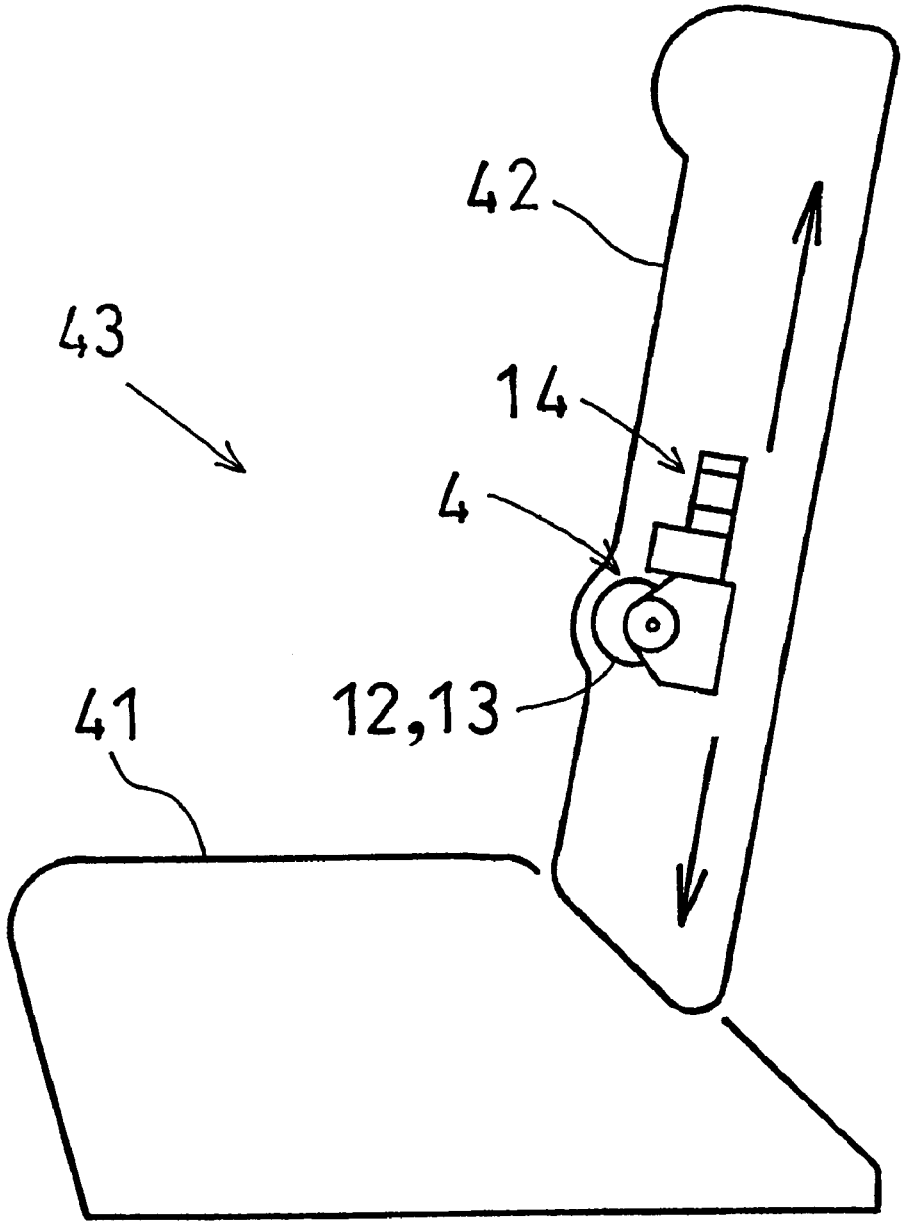
FIG. 9 is a schematic side view showing a chair-type massaging apparatus.

FIG. 9 illustrates a second embodiment of the present invention.

This embodiment is a chair-type massaging apparatus 43 including a seat portion 41, a backrest portion 42 extending upwardly from an end portion of the seat portion 41, and the aforementioned roller massaging mechanism 4 shown in FIG. 1 and disposed within the backrest portion 42.

It should be noted that the roller massaging mechanism 4 may be incorporated also in the seat portion 41 or in a footrest (not shown) as well as in the backrest portion 42.

If shift means is provided for upwardly and downwardly shifting the roller massaging mechanism 4 disposed within the backrest portion 42, it is possible to massage a larger extent of a user's body from the occiput portion through the back to the waist.

Figure 10:
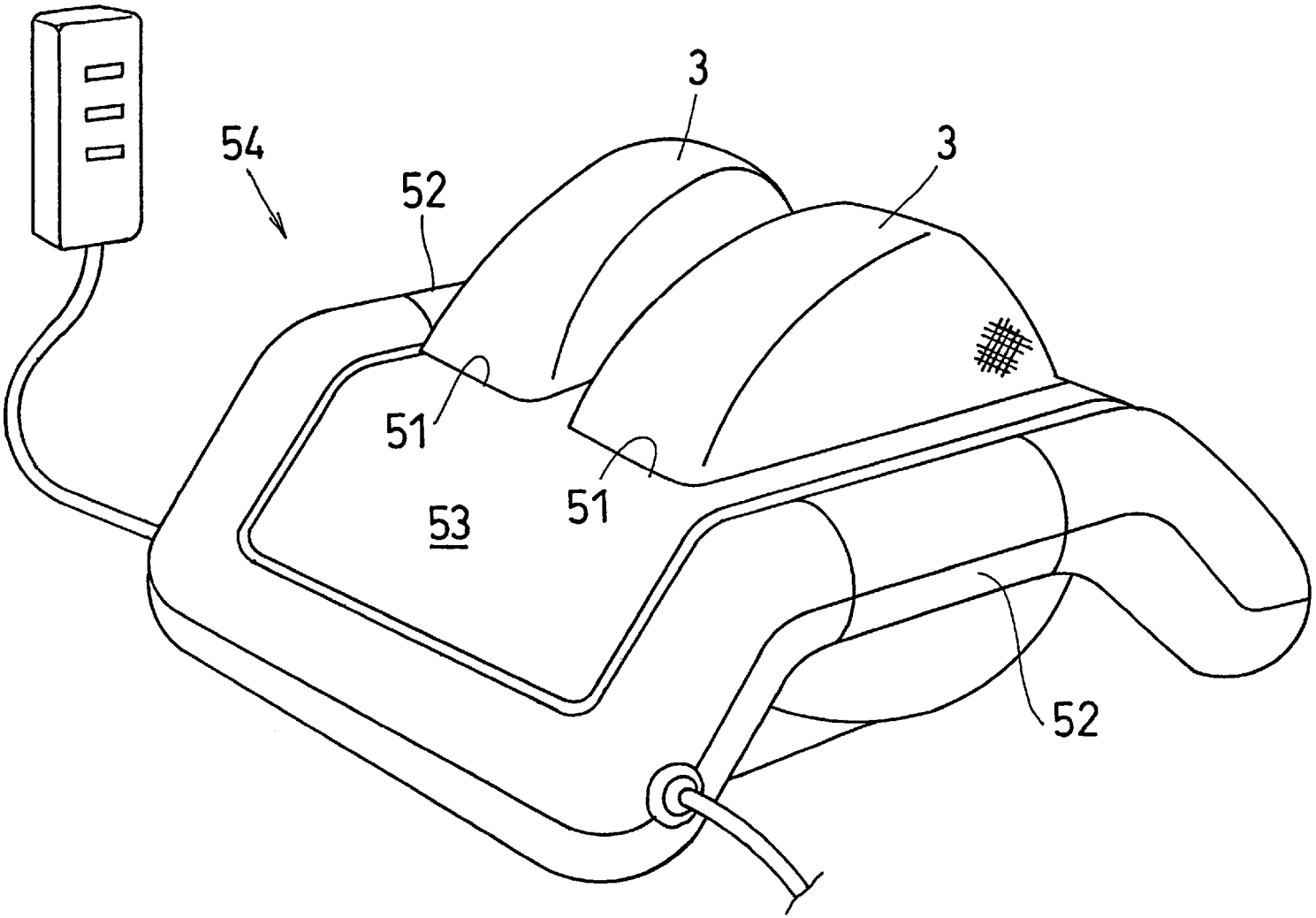
FIG. 10 is a perspective view showing a hand-carriable massaging apparatus.
Figure 11:
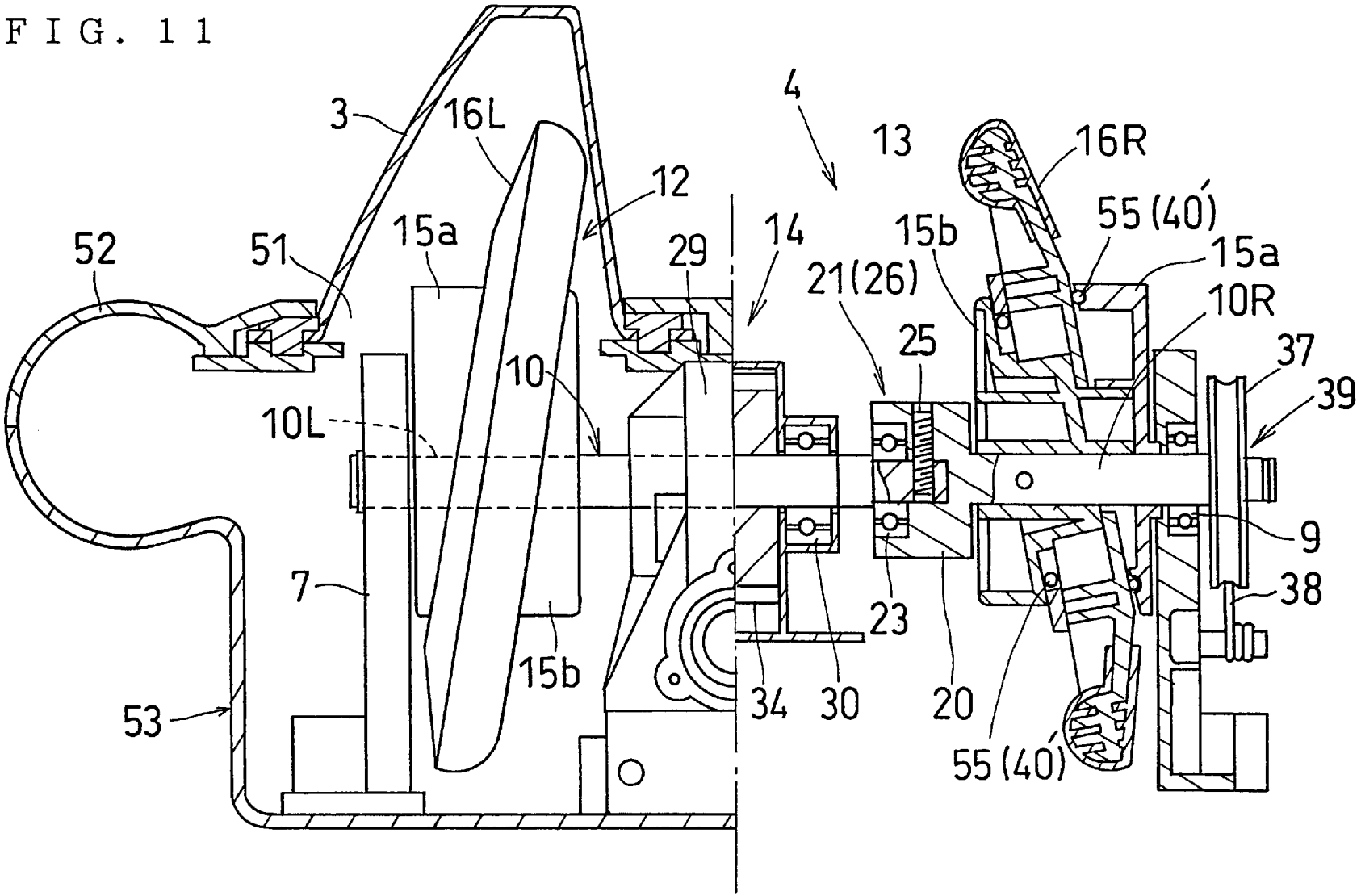
FIG. 11 is a front sectional view showing the hand-carriable massaging apparatus.

FIGS. 10 and 11 illustrate a third embodiment of the present invention.

This embodiment is a hand-carriable massaging apparatus 54 including a hand-carriable casing 53 having an opening 51 on a front side thereof (on the top side in FIG. 10) and grip portions 52 on right and left lateral sides thereof, and the roller massaging mechanism 4 disposed in the casing 53.

The casing 53 shown defines a pair of right and left openings 51,51 on the top side thereof through which the right and left massaging rollers 16R,16L project upwardly from the casing 53. The cover member 3 shown is divided into right and left separate ones for closing the openings 51,51, respectively.

As shown in FIG. 11, second brake means 40' employed in this embodiment comprises a ring spring 55 disposed on opposite sides of each massaging rollers 16R,16L. The ring spring 55 is inserted in a clearance between each sandwiching plate 15*a*, 15*b* and each massaging rollers 16R,16L to provide a friction resistance against the rotation of the rollers 16R,16L about the rotary shaft 10.

The grip portions 52 are each a cylindrical portion formed integrally with each of the right and left lateral sides of the casing 53 for an operator to press the massaging apparatus 54 against the back of another person for massage by holding these portions 52 with both hands.

The massaging apparatus 54 according to this embodiment can rest on a floor or the like with the massaging rollers 16 oriented upwardly as shown in FIG. 10 and hence can be used also as a stationary-type massaging apparatus of a small size.

Figure 12:
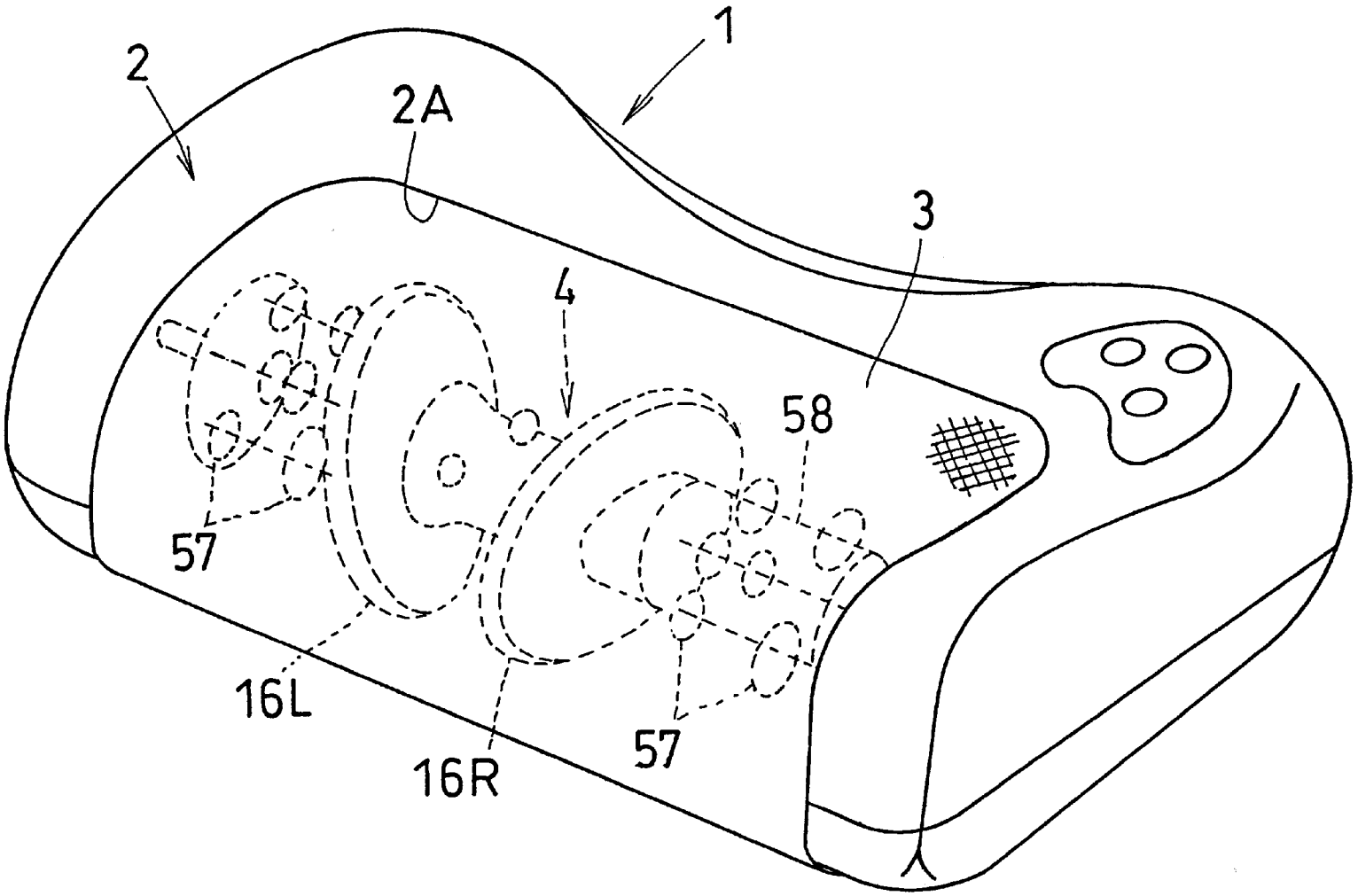
FIG. 12 is a perspective view showing another stationary-type massaging apparatus.
Figure 13:
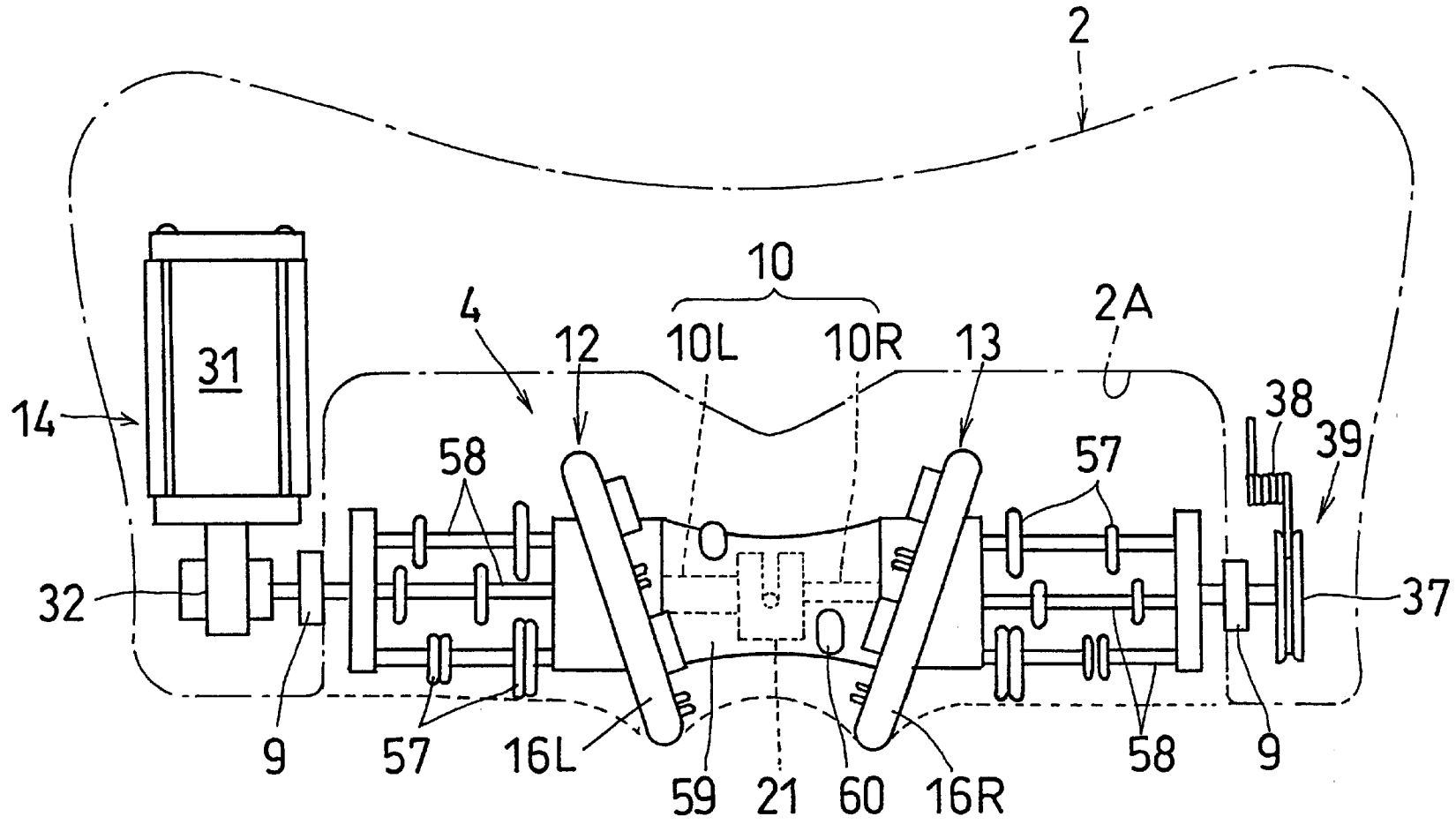
FIG. 13 is a plan view showing the inner structure of the stationary-type massaging apparatus.
Figure 14:
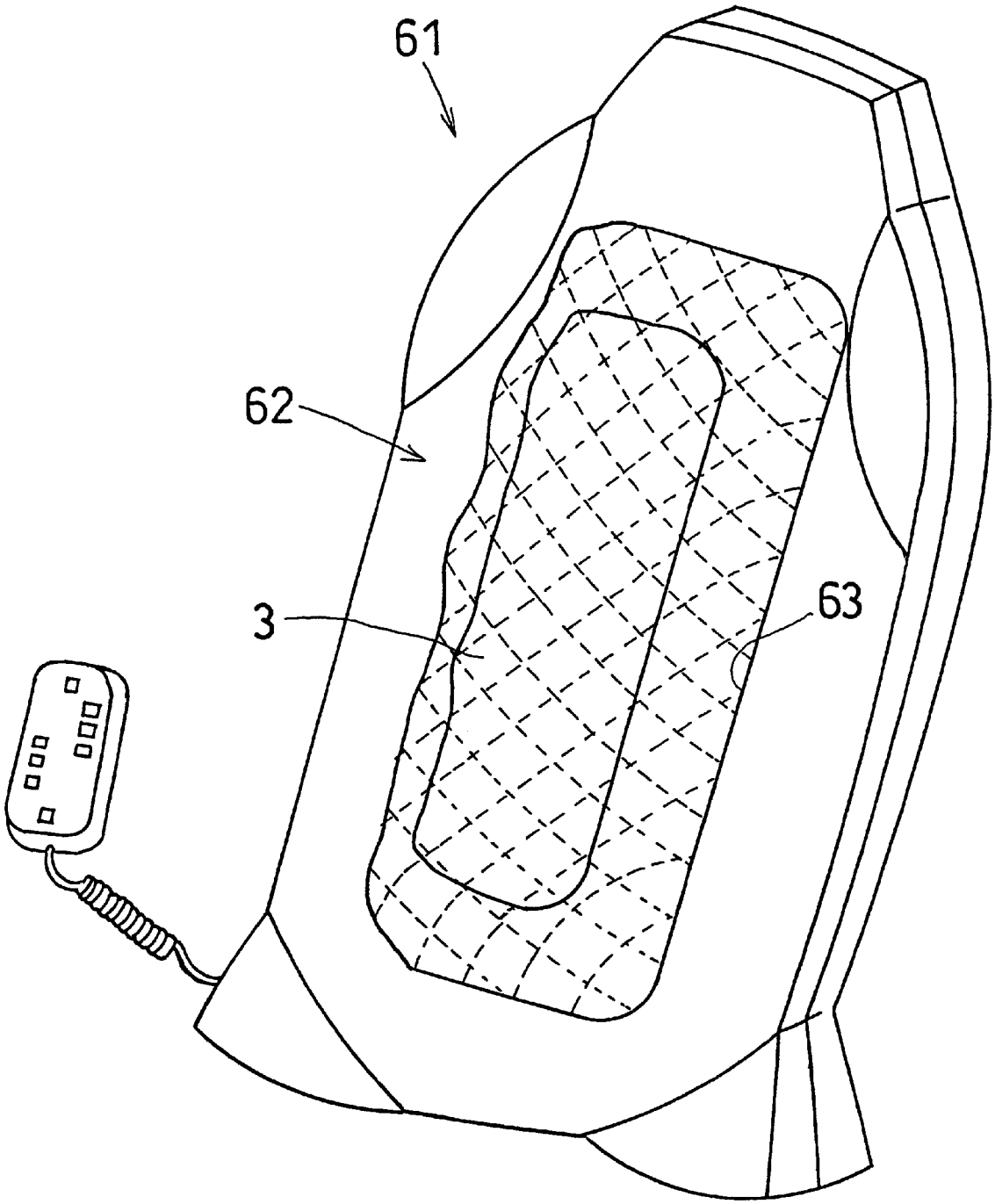
FIG. 14 is a perspective view showing a leaner-type massaging apparatus.

FIGS. 12 and 13 illustrate a fourth embodiment of the present invention.

Like the first embodiment, this embodiment also is a stationary-type massaging apparatus 1 including stationary-type casing 2 having an opening 2A on the top side thereof, and roller massaging mechanism 4 housed in the casing 2. The fourth embodiment is different from the first embodiment in the following points.

That is, the roller massaging mechanism 4 includes, as well as a pair of right and left massaging rollers 16R,16L, a multiplicity of mini-rollers 57 disposed around a portion of the rotary shaft 10 situated closer to each end of the rotary shaft 10 than a portion thereof on which the massaging rollers 16R,16L are mounted. The mini-rollers 57 are mounted with a predetermined spacing on a plurality of rotatable shafts 58 secured around the rotary shaft 10.

With this arrangement if the user places his or her calves or the like on the massaging apparatus 1 at locations adjacent the opposite ends of the rotary shaft 10, the user can enjoy a rolling massage performed by the multiplicity of mini-rollers 57 rolling on an affected part as well as a kneading massage or a like massage performed by the massaging rollers 16.

In the massaging mechanism 4 employed in this embodiment drive means 14 comprising motor 31 and reduction gear device 32 is connected to the left end of the rotary shaft 10 and is disposed in a left portion of the casing 2 as shown.

Further, half-turn clutch 21 is covered with a sleeve 59 made of resin having massaging projections 60 on an outer periphery thereof, the sleeve 59 serving to prevent the half-turn clutch 21 from catching the cover member 3 therearound when the cover member 3 sags into the casing 2.

FIGS. 14 to 17 illustrate a fifth embodiment of the present invention.

Massaging apparatus 61 according to this embodiment is of a leaner type including an independent one-piece casing 62 having a longitudinal length substantially corresponding to that of the back of a human and capable of leaning against a wall face W with its back side facing the wall face W, and the aforementioned roller massaging mechanism 4 longitudinally movably disposed in the casing 62.

The overall configuration of the casing 62 used in this embodiment is a longitudinally elongated flat box having a longitudinally extending opening 63 on a front side thereof. The casing 62 is capable of leaning against wall face W defining a room as shown in FIG. 16, or against wall face W of the backrest of a chair 64 as shown in FIG. 17.

Figure 16:
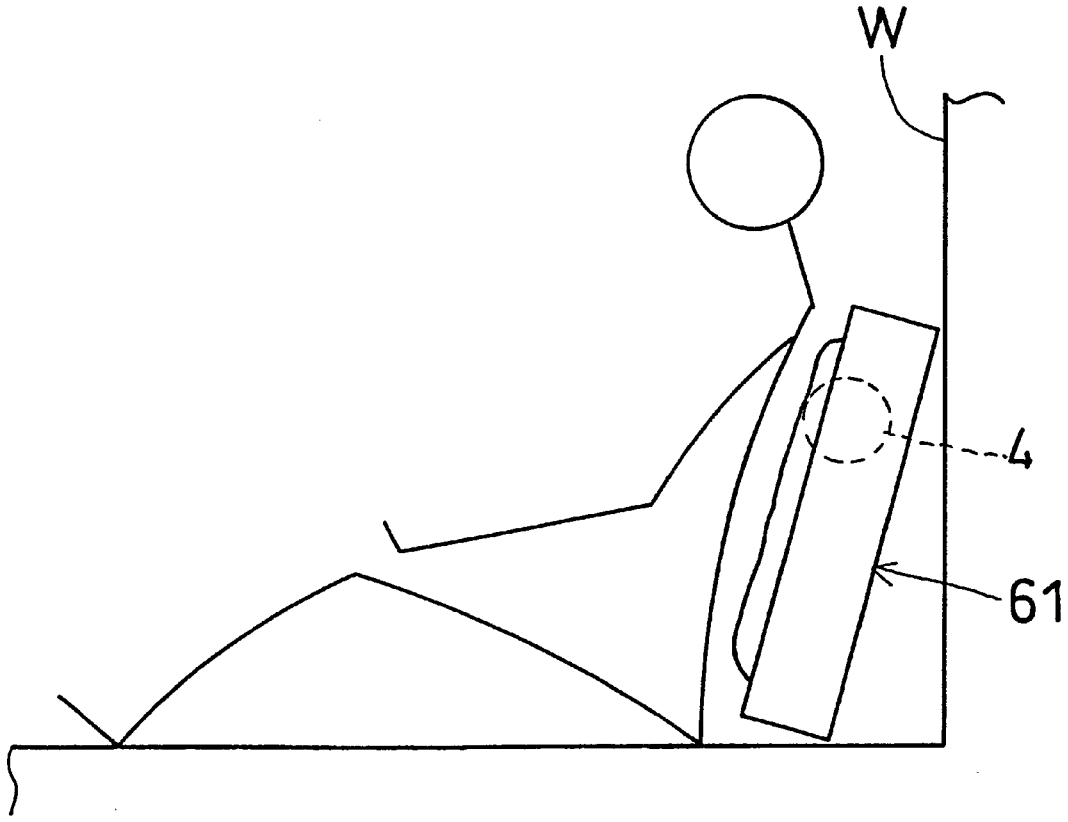
FIG. 16 and FIG. 17 are side views showing examples of use of the leaner-type massaging apparatus.
Figure 17:
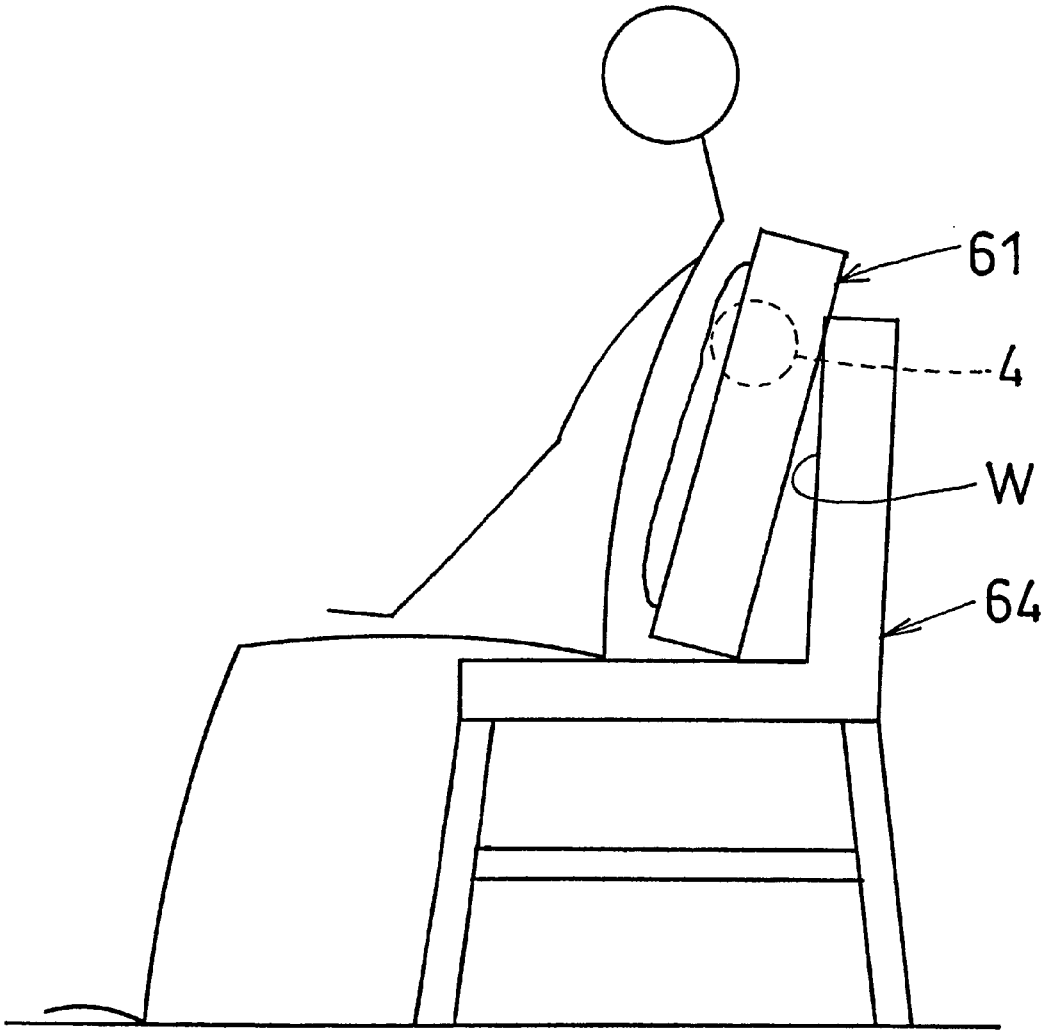

Since the casing 62 is of such a longitudinally elongated flat box configuration capable of leaning against the wall face W, the massaging apparatus 61 is able to massage the back of the user over a large extent as in the case of the chair-type massaging apparatus 43 if it is used when leaning against a wall face W as shown in FIG. 16 or 17.

On the other hand, since the casing 62 is of the longitudinally elongated flat box configuration unlike the chair-type massaging apparatus 43, the massaging apparatus 61 can easily be stored in a narrow space such as in a corner of a room or between furniture articles. Thus, the massaging apparatus 61 is a compact and inexpensive massaging apparatus having substantially the same function as the chair-type massaging apparatus 43.

Figure 15:
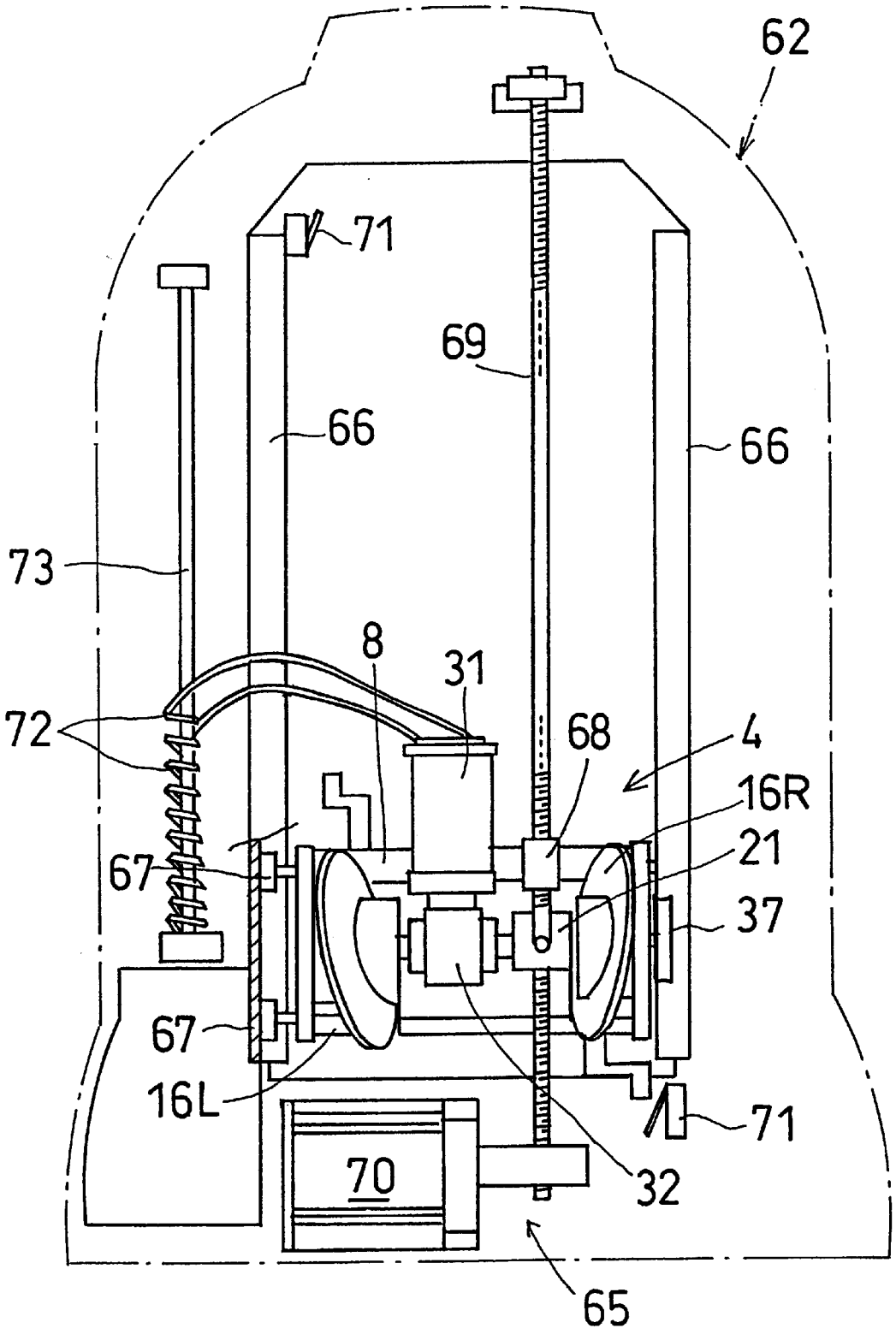
FIG. 15 is a front view showing the inner structure of the leaner-type massaging apparatus.

As shown in FIG. 15, shift means 65 is provided in the casing 62 for shifting the roller massaging mechanism 4 longitudinally of the. casing 62.

The shift means 65 includes a pair of right and left guide rails 66 longitudinally extending on right and left lateral sides of the casing 2, guide rollers 67 disposed at the four corners of the support frame 8 of the massaging mechanism 4 and rollably fitted in the guide rails 66, a feed screw shaft 69 extending through a threaded pipe 68 secured to the support frame 8, and a shift motor 70 for driving the feed screw shaft 69.

The feed screw shaft 69 is rotatably supported substantially centrally of the casing 61 so as not to move axially, and the threaded pipe 68 threadingly engages the outer periphery of the feed screw shaft 69. Thus, as the feed screw shaft 69 is rotated by the shift motor 70, the support frame 8 connected to the threaded pipe 68 moves longitudinally thereby shifting the massaging position of the massaging rollers 16R,16L relative to the user.

On the upper and lower ends of the guide rails 66 are provided limit switches 71 for establishing the upper and lower shifting limits of the massaging mechanism 4. Further, a guide shaft 73 around which electric wires 72 of the motor 31 associated with the massaging mechanism 4 are spirally wound is fixed on the left side of the left guide rail 66. Even if the electric wires 72 are loosened in the casing 2 by repeated upward and downward shifting of the massaging mechanism 4, this arrangement prevents the loosened wires 72 from being caught and drawn toward an unexpected direction and hence from being broken thereby.

Further, the massage drive motor 31 is disposed to project away from the shift motor 70 (upwardly in FIG. 15) in this embodiment and, hence, there is no need to provide a dead space for avoiding interference between the two motors 31 and 70, resulting in the casing 62 having a reduced longitudinal dimension.

It should be noted that the foregoing second to fifth embodiments have been described concisely without redundant repeated descriptions by giving like numerals to elements having functions or structures as same as or similar to those of the first embodiment.

It should also be noted that the embodiments described herein are only illustrative of the present invention but not limitative of the present invention. The scope of the present invention is defined by the appended claims, and all variations and equivalents which can read on the claims are included in the present invention.

While the rotary shaft 10 is provided with the dividing portion 10*a* and the half-turn clutch 21 is disposed in the dividing portion 10*a* as an example of the arrangement for switching the position of the massaging rollers 16, it is possible to employ any other mechanical switching structure, electromagnetic clutch mechanism or manually-operated switching mechanism as an alternative.

The massaging rollers 16 may each be differently varied in configuration so long as the overall configuration thereof is substantially discoid, for example, in the form of an elliptic disc or a polygonal disc.

Further, the massaging mechanism 4 of the present invention may be incorporated into a bed-type massaging apparatus.

INDUSTRIAL APPLICABILITY

The present invention provides a roller massaging mechanism capable of performing a kneading massage operation and other massage operations by means of a pair of right and left massaging rollers.

This massaging mechanism can be incorporated into various massaging apparatus such as relatively small massaging apparatus of stationary type or hand-carriable type, and relatively large massaging apparatus of leaner type or chair type.

What is claimed is:

1. A roller massaging mechanism comprising:

a rotary shaft (10);

a pair of right and left massaging rollers (16R,16L) mounted on an intermediate portion of the rotary shaft (10) in a slanted fashion relative to an axis of the rotary shaft (10);

drive means (14) for rotary-driving the rotary shaft (10); and switching means (26) for selectively switching the position of the pair of right and left massaging rollers (16R,16L) into one of a kneading position where the massaging rollers (16R,16L) are slanted opposite to each other and a non-kneading position where the massaging rollers (16R,16L) are slanted parallel with each other.

2. A roller mechanism as set forth in claim 1, wherein the pair of right and left massaging rollers (16R, 16L) are mounted eccentrically relative to the rotary shaft (10) such that a lower portion of one massaging roller (16R, 16L) selectively becomes more distant front the rotary shaft (10) relative to a lower portion of the other massaging roller (16R, 16L).

3. A roller massaging mechanism as set forth in claim 1, wherein the drive means (14) is capable of varying the rotary speed of the rotary shaft (10) to at least two levels when the pair of right and left massaging rollers (16R,16L) are in the non-kneading position.

4. A roller massaging mechanism as set forth in claim 1, wherein:

the rotary shaft (10) comprises a first shaft portion (10L) supporting one massaging roller (16L), and a second shaft portion (10R) supporting the other massaging roller (16R) and disposed coaxially with the first shaft portion (10L); and the switching means (26) comprises a half-turn clutch (21) restricting a turnable range of one of the first shaft portion (10L) and the second shaft portion (10R) relative to the other to about a half turn.

5. A roller massaging mechanism as set forth in claim 4, wherein the half-turn clutch (21) includes:

a tubular member (20) unrotatably and coaxially secured to an end portion of the second shaft portion (10R) and defining in an outer periphery thereof a transverse slot (24) having a length circumferentially of the tubular member (20) which corresponds to the half turn; and a stopper pin (25) projecting radially outwardly of an end portion of the first shaft portion (10L) rotatably and coaxially inserted into the tubular member (20) and having a tip portion staying within the transverse slot (24).

6. A roller massaging mechanism as set forth in claim 4, wherein brake means (39) is provided for applying a frictional resistance against rotation of one of the first and second shaft portions (10L,10R) which is situated on a driven side not directly rotary-driven by the drive means (14).

7. A roller massaging mechanism as set forth in claim 1, wherein the pair of right and left massaging rollers (16R, 16L) are coupled to the rotary shaft (10) so as to be rotatable relative to the rotary shaft (10), and second brake means (40) is provided for providing a frictional resistance against rotation of the pair of right and left massaging rollers (16R,16L) relative to the rotary shaft (10).

8. A roller massaging mechanism as set forth in claim 1, further comprising a multiplicity of mini-rollers (57), disposed around a portion of the rotary shaft (10) situated closer to each end of the rotary shaft (10) than a portion of the rotary shaft (10) on which the pair of right and left massaging rollers (16R,16L) are mounted, for performing a rolling massage relative to an affected part of a human.

9. A stationary massaging apparatus comprising a stationary casting (2) defining an opening (2A) oriented upward, and a roller massaging mechanism (4) housed in the casing (2), the roller massaging mechanism (4) including:

a rotary shaft (10) rotatably supported by the casing (2);

a pair of right and left massaging rollers (16R, 16L) mounted on an intermediate portion of the rotary shaft (10) at a location corresponding to the opening (2A) in a slanted fashion relative to an axis of the rotary shaft (10);

drive means (14) for rotary-driving the rotary shaft (10); and switching means (26) for selectively switching the position of the pair of right and left massaging rollers (16R, 16L) into one of a kneading position where the massaging rollers (16R, 16L) are slanted opposite to each ocher and a non-kneading position where the massaging rollers (16R, 16L) are slanted parallel with each other.

10. A hand-carriable massaging apparatus comprising a hand-carriable casing (53) defining an opening (51) on a front side thereof and having a grip portion (52) on right and left sides thereof, and a roller massaging mechanism (4) housed in the casing (52), the roller massaging mechanism (4) including:

a rotary shaft (10) rotatably supported by the casing (53);

a pair of right and left massaging rollers (16R,16L) mounted on an intermediate portion of the rotary shaft (10) at a location corresponding to the opening (51) in a slanted fashion relative to an axis of the rotary shaft (10);

drive means (14) for rotary-driving the rotary shaft (10); and switching means (26) for selectively switching the position of the pair of right and left massaging rollers (16R,16L) into one of a kneading position where the massaging rollers (16R,16L) are slanted opposite to each other and a non-kneading position where the massaging rollers (16R,16L) are slanted parallel with each other.

11. A leaner massaging apparatus comprising leaner casting (62) having an opening (63) on a front side thereof, the casting (62) being an independent one-piece casting having a longitudinal dimension substantially corresponding to that of the back of a human and capable of leaning against a wall face (W) with its back side facing the wall face (W), and a roller massaging mechanism (4) housed in the casting (62), the roller massaging mechanism (4) including a transversely extending rotary shaft (10) rotatably supported in the casting (62);

a pair of right and left massaging rollers (16R, 16L) mounted on an intermediate portion of the rotary shaft (10) at a location corresponding to the opening (63) in a slanted fashion relative to an axis of the rotary shaft (10);

drive means (14) for rotary-driving the rotary shaft (10); and switching means (26) for selectively switching the position of the pair of right and left massaging rollers (16R, 16L) into one of a kneading position where the massaging rollers (16R, 16L) are slanted opposite to each other and a non-kneading position where the massaging rollers (16R, 16L) are slanted parallel with each other.

12. A massaging apparatus as set forth in claim 11, further comprising shift means (65) for shifting the roller massaging mechanism (4) longitudinally.

13. A chair massaging apparatus comprising a seat portion (41), a backrest portion (40) extending upward from an end portion of the seat portion (41), and a roller massaging mechanism (4) disposed within the backrest portion (40), the roller massaging mechanism (4) including:

transversely extending rotary shaft (10) rotatably supported in the backrest potion (40);

a pair of right and left massaging rollers (16R, 16L) mounted on an intermediate potion of the rotary shaft (10) at a location corresponding to a transversely central portion of the backrest portion (40) in a slanted fashion relative to an axis of the rotary shaft (10);

drive means (14) for rotary-driving the rotary shaft (10); and switching means (26) for selectively switching the position of the pair of right and left massaging rollers (16R, 16L) into one of a kneading position where the massaging rollers (16R, 16L) are slanted opposite to each other and a non-kneading position where the massaging rollers (16R, 16L) are slanted parallel with each other.

14. A massaging apparatus as set forth in claim 13, further comprising shift means for shifting the roller massaging mechanism (4) upwardly and downwardly.

* * * * *